US006872073B2

(12) United States Patent
Collmer et al.

(10) Patent No.: US 6,872,073 B2
(45) Date of Patent: Mar. 29, 2005

(54) BURNER ARRANGEMENT FOR A HEATING DEVICE, AND HEATING DEVICE, PARTICULARLY VEHICLE HEATING DEVICE

(75) Inventors: Andreas Collmer, Ostfildern (DE); Patric Schlecht, Ostfildern (DE); Jürgen Wagner, Wendlingen (DE)

(73) Assignee: J. Eberspacher GmbH & Co. KG, Esslingen (DE)

( * ) Notice: Subject to any disclaimer, the term of this patent is extended or adjusted under 35 U.S.C. 154(b) by 0 days.

(21) Appl. No.: 10/814,499

(22) Filed: Mar. 30, 2004

(65) Prior Publication Data

US 2004/0197723 A1 Oct. 7, 2004

(30) Foreign Application Priority Data

Apr. 1, 2003 (DE) ..... 103 14 836

(51) Int. Cl.[7] ..... F23D 14/46

(52) U.S. Cl. ..... 431/261; 431/326; 431/350

(58) Field of Search ..... 431/261, 263, 431/266, 326, 327, 350; 126/95, 96; 237/12.3 C

(56) References Cited

U.S. PATENT DOCUMENTS 4,471,754 A * 9/1984 Galtz ..... 126/110 B
4,729,365 A * 3/1988 Mutchler ..... 126/110 B
5,947,717 A * 9/1999 Steiner et al. ..... 431/350
6,089,465 A * 7/2000 Habijanec et al. ..... 237/12.3 C
6,681,889 B2 * 1/2004 Collmer et al. ..... 181/251
6,811,395 B2 * 11/2004 Schlecht ..... 431/261

FOREIGN PATENT DOCUMENTS

| | | | |
|---|---|---|---|
| DE | 1 454 672 | 10/1962 | |
| DE | 21 39 504 | 8/1971 | ..... F24H/3/06 |
| DE | 31 36 839 C2 | 9/1981 | ..... B60H/1/22 |
| DE | 32 33 321 A1 | 9/1982 | ..... F23D/5/12 |
| DE | 41 00 523 A1 | 1/1991 | ..... B60H/1/22 |
| DE | 100 19 890 A1 | 4/2000 | ..... F23D/11/40 |
| EP | 0 483 520 A3 | 9/1991 | ..... F23C/9/00 |

OTHER PUBLICATIONS

German Search Report for corresponding German Application dated Apr. 1, 2003.
European Search Report for corresponding European Application dated May 17, 2004.

* cited by examiner

*Primary Examiner*—Stephen Gravini

(57) ABSTRACT

A burner arrangement for a heating device, particularly a vehicle heating device, comprising a combustion chamber (18) and a flame tube (22) conducting the combustion products away from the combustion chamber (18), having an inlet region (28) near the combustion chamber (18) at which combustion products enter the flame tube (22) and an outlet region (36) at which combustion products leave the flame tube (22). At least one intermediate outlet region (42) between the inlet region (28) and the outlet region (36), in which intermediate outlet region (42) a portion of the combustion products can emerge from the flame tube (22).

14 Claims, 4 Drawing Sheets

BURNER ARRANGEMENT FOR A HEATING DEVICE, AND HEATING DEVICE, PARTICULARLY VEHICLE HEATING DEVICE

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a burner arrangement for a heating device, particularly a vehicle heating device, comprising a combustion chamber and a flame tube conducting the combustion products away from the combustion chamber, having an inlet region near the combustion chamber at which combustion products enter the flame tube and an outlet region at which combustion products leave the flame tube; and furthermore relates to a heating device, particularly vehicle heating device, having such a burner arrangement.

FIELD OF THE INVENTION

It is known, in vehicle heating devices constructed to cooperate with an elongate heat exchanger device, to conduct the combustion gases leaving a combustion chamber through an elongate flame tube, generally of cylindrical form, firstly in the direction of the combustion chamber and in fact to a pot-shaped heat exchanger housing surrounding a floor region of this flame tube. At this floor region, the combustion products leaving the flame tube at the exit region and transporting heat to be transferred to the medium to be heated are deflected so that they flow back along an interspace formed between the outside of the flame tube and the inside of the heat exchanger housing, and thereby transfer heat to the heat exchanger housing and thus to the medium to be heated circulating therein, before they are discharged to an exhaust gas treatment system or the like. This in particular results in that, with comparatively long heat exchanger housings or correspondingly long flame tubes, the combustion products, deflected once at the floor region of the heat exchanger housing and then flowing back, increasingly lose heat, and thus the heat transfer to the medium to be heated in the course of the back flow of the combustion products is made worse.

BRIEF SUMMARY OF THE INVENTION

The present invention has as its object to provide a burner arrangement for a heating device, and also a heating device, particularly vehicle heating device, with which an improved and uniform delivery of heat from the combustion products can be obtained.

According to the present invention, this object is attained by means of a burner arrangement for a heating device, particularly vehicle heating device, including a combustion chamber and a flame tube leading the combustion products away from the combustion chamber, with an inlet region near the combustion chamber in which combustion products enter the flame tube, and an outlet region in which combustion products leave the flame tube, furthermore including at least one intermediate outlet region between the inlet and the outlet region, in which intermediate outlet region a portion of the combustion gases can leave the flame tube.

By the provision of the at least one intermediate outlet region, a distribution over the length of the flame tube is attained of the combustion gases with very high temperature leaving the combustion chamber for heating the fluid circulating in a heat exchanger arrangement, so that even in an intermediate region, or a region of the flame tube adjacent to the combustion chamber, combustion products can be provided with higher temperature for transfer of heat to a medium to be heated. This has the consequence that the whole surface of a heat exchanger housing available for heat transfer can be more efficiently used, and in addition, can lead to a uniform temperature transfer to the medium to be heated with defined temperature properties in this medium then leaving the heat exchanger arrangement.

For example, it can be provided that the flame tube has as least one intermediate outlet aperture in the at least one intermediate outlet region.

For the provision of the at least one intermediate outlet aperture, it is possible that the flame tube has at least two flame tube sections, and that an intermediate outlet aperture is provided in a transition region between an upstream one—relative to a flow direction of the combustion products in the flame tube—and a downstream one of the flame tube sections. The outlet of the combustion products from the flame tube can then be made possible in this region in a very simple manner, in that an aperture in the transition region between the flame sections forms at least a portion of an intermediate outlet aperture.

In one embodiment, it can be provided that the upstream flame tube section has a greater cross sectional dimension than the downstream flame tube section; furthermore, preferably, the downstream flame tube section engages in the upstream flame tube section, and at least a portion of an intermediate outlet aperture is provided in the overlapping region of the upstream flame tube section with the downstream flame tube section. This embodiment has the particular advantage that the combustion products, otherwise flowing in the longitudinal direction of the upstream flame tube section, can enter the annular overlapping region formed between the two flame tube sections without previous deflection, so that there is also no risk of a flow blockage. Furthermore, the construction of the flame tube with its flame tube sections with different cross sectional dimensions has the consequence that in a section of the flame tube closer to the inlet section, the flame tube has a greater external dimension than in a region close to the outlet region. The consequence of this is that a corresponding cross section change is also present between the outer periphery of the flame tube and a flow space formed between the outer periphery of the flame tube and an inner surface of a heat exchanger housing surrounding this, and in fact in the sense that a greater flow cross section area is present in the region of this flow space located close to the outer region, than in the region of this flow space located close to the inlet region of the flame tube. Thus the fact can be taken into account that the combustion products flowing through this flow space become colder, and thus their volume decreases, so that efficient heat transfer can be obtained even with colder combustion products requiring a smaller volume. In order to hold different flame tube sections in defined relative positioning, it is proposed that the downstream flame tube section is supported on the upstream flame tube section by at least one support region.

In an embodiment which is particularly easy to manufacture, it is furthermore proposed that the downstream flame tube section and the upstream flame tube section are formed substantially cylindrically. It is thus possible to produce the two flame tube sections simply by cutting sheet metal tubes into lengths.

In a further alternative embodiment it can be provided that the at least one intermediate outlet aperture is formed in an outer wall of the flame tube.

According to a further aspect, the object mentioned hereinabove is attained by a heating device, particularly vehicle heating device, which has a burner arrangement according to the invention, and also a heat exchanger arrangement with a heat exchanger housing into which the flame tube projects.

In order to ensure a defined mounting in a simple manner when the flame tube is formed from several flame tube sections, it is proposed that a support structure for supporting at least one flame tube section is provided on a side of the heat exchanger housing facing toward the flame tube. For example, it is possible that plural ribs extending longitudinally of the flame tube are provided on the heat exchanger housing, and that the support structure includes at least a portion of the ribs. In general, such ribs are present anyway for heat exchanger housings, in order to enlarge the heat transfer surface and simultaneously to define a flow direction for the combustion products.

In a particularly easily produced embodiment, it can then be provided that at least one flame tube section is supported by clamping action between plural ribs distributed over its periphery. Alternatively or additionally, it is provided that the at least one flame tube section is retained on at least one of the ribs by riveting, screwing, or the like. The present invention is described in detail hereinafter with reference to the accompanying drawings.

DETAILED DESCRIPTION OF THE INVENTION

Figure 1:
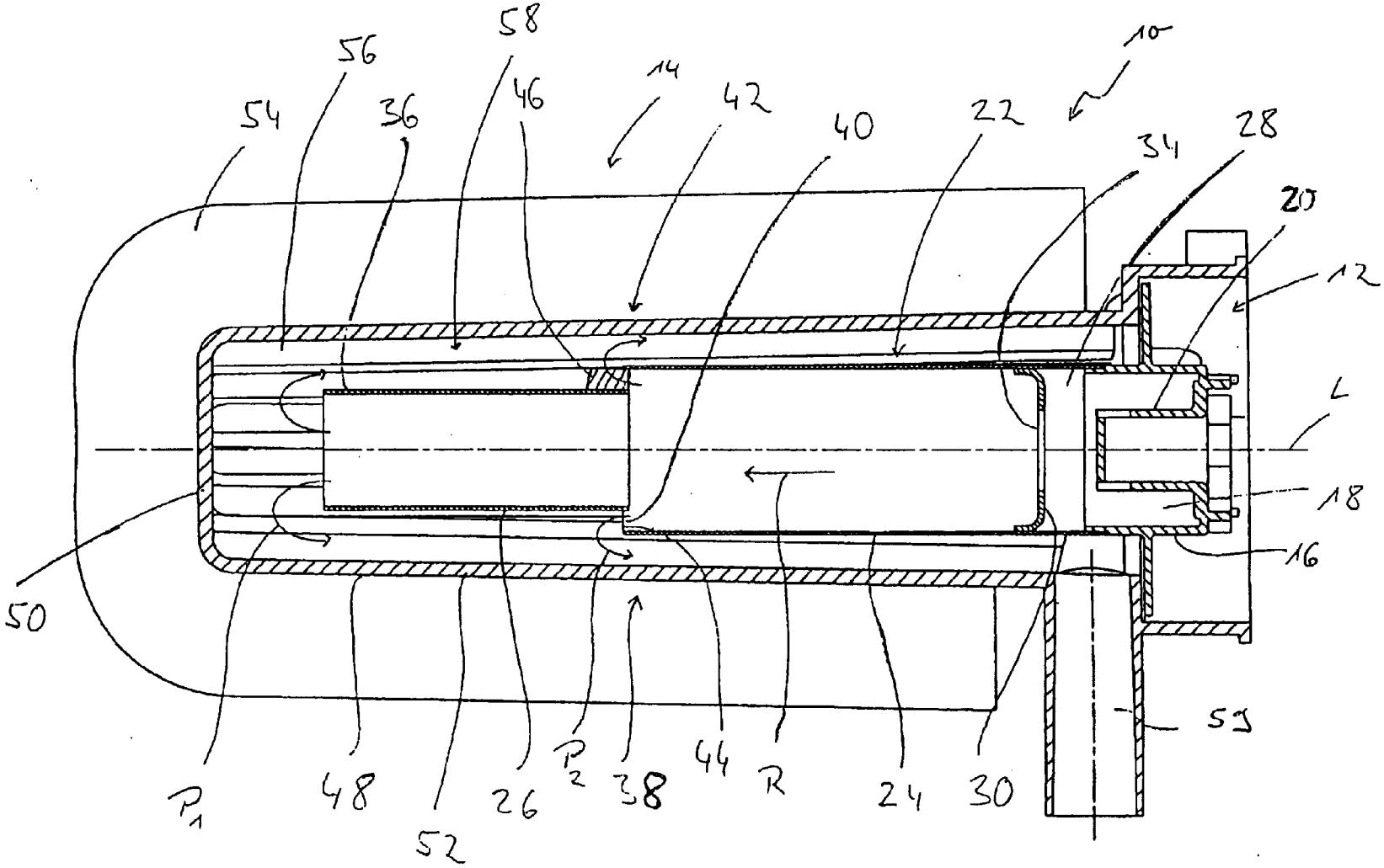
FIG. 1 shows a longitudinal section of a burner arrangement according to the invention in connection with a heat exchanger arrangement.

Portions of a vehicle heater device 10 formed according to the principles of the present invention are shown in longitudinal section in FIG. 1, thus sectioned along a longitudinal mid axis L. The vehicle heating device 10 includes a burner arrangement 12 and also a heat exchanger arrangement 14, of which respectively only the components relevant for the principles of the present invention are shown.

The burner arrangement 12 includes a substantially pot-shaped combustion chamber housing 16, in which a combustion chamber 18 is formed. Combustion air is introduced into the combustion chamber 18 by the delivery action of a combustion air fan (not shown) via a combustion air inlet pipe 20 provided centrally in the combustion chamber housing. Also, fuel is introduced via a fuel supply (not shown), for example, by evaporative action, so that an ignitable or combustible fuel/air mixture is produced in the combustion chamber 18. This mixture, for example ignited by a glow ignition element, produces a flame and combustion exhaust gases which leave the combustion chamber 18 at the side, seen on the left in FIG. 1, and enter a flame tube generally denoted by 22.

The flame tube 22 which can be seen in FIG. 1 has two flame tube sections 24, 26, substantially cylindrical in shape. It can be seen that these two flame tube sections 24, 26 have different dimensions. The flame tube section 24 positioned upstream relative to the flow direction R of the combustion products in the flame tube 22 and having a greater cross sectional dimension is positioned bordering on, or connected to, the combustion chamber 16 and forms an inlet region 28 of the flame tube 22 into which the combustion products enter. In or near this inlet region 28, a flame diaphragm 30 with a central passage aperture for the combustion is supported in the flame tube 22.

The flame tube section 26 which has a smaller cross sectional dimension than the upstream flame tube section 24 forms an outlet region 36 of the flame tube 22 in which the combustion products which have flowed as far as this outlet region 36 leave the flame rube 22 as shown be the arrow $P_1$.

In the transition region 38 between the two flame tube sections 24, 26, these two flame tube sections 24, 26 are overlapped, so that an annular aperture region 40 is formed between them. This aperture region 40 defines an intermediate outlet region 42 in which combustion products which have flowed along the flame tube section 24, and in fact along a wall region of the same, can emerge from the flame tube 22 as indicated by the arrow $P_2$. In this intermediate outlet region 42 in which the said aperture region 40 forms an intermediate outlet aperture 44, the two flame tube sections 24, 26 are mutually supported. For this purpose, outward-projecting support sections 46 are provided on the downstream flame tube section 26, for example soldered or adhered at plural peripheral positions thereon, which engage like the flame tube section 26 in the flame tube section 24 and thus retain the two flame tube sections 24, 26 relative to each other. Fixing on the flame tube section 24 by soldering or the like can also take place here.

Only an inner heat exchanger housing 48 of the heat exchanger arrangement 14 is shown in FIG. 1. This has a substantially pot-like structure with a floor wall 50 and a peripheral wall 52. So-called external ribs 54 are provided on the outside of the floor wall 50 and of the peripheral wall 52, and conduct heat and transfer it to the medium to be heated circulating in the heat exchanger arrangement 14. So-called internal ribs 56 are provided on the inner side, and thus on the side turned toward the flame tube 22, of the heat exchanger housing 22, and extend, starting from the floor region 50, in the longitudinal direction of the flame tube 22, substantially over the whole length of the heat exchanger housing 48 or of the peripheral wall 52 of the same. These internal ribs 56 act to enlarge the heat transfer surface at which the heat from the combustion products leaving the flame tube 22 is transferred to the heat exchanger housing 48, and also act to confer a given defined flow direction to the combustion products flowing back to an outlet 59.

Thus in heating operation the combustion products leaving the combustion chamber 18 in the inlet region 28 through the central aperture 34 of the flame diaphragm 30 first enter the upstream flame tube section 24 of the flame tube 22 and flow in the direction R toward the transition region 38. A portion of the combustion products now emerges from the flame tube into the intermediate outlet region 42. The remaining portion flows into the downstream flame tube section 26 and leaves the flame tube 22 at the outlet region 36, and is deflected there by the floor region 50, in order to flow back along an interspace 58 formed between the outer side of the flame tube 22 and the peripheral wall 52 of the heat exchanger housing 48. By the division of the combustion products into two partial streams, the effect is obtained that not only do very hot combustion products come into contact at the outlet region 36 with the heat exchanger housing 48 and then gradually cool down on flowing back, but that also in an intermediate region, namely the region where the intermediate outlet region 42 is located, very hot combustion products which have not yet previously contributed to heating the heat exchanger arrangement 48 enter the interspace 58 and then flow back together with the combustion products which have emerged at the outlet region 36. This increases the temperature of the combustion products heating the heat exchanger housing 48 in that region of the interspace 58 located between the flame tube section 24 and the peripheral wall 52 of the heat exchanger housing 48. Because of this, a more uniform heat transfer to the heat exchanger arrangement 48, and thus to the medium to be heated circulating therein, can be obtained.

It can also be seen that by the design of the two flame tube sections 24, 26 with the cross sectional dimension decreasing in the flow direction R, the interspace 58 likewise has different cross sectional dimensions. In that region in which it surrounds the flame tube section 26, the interspace 58 has a greater cross sectional dimension than in that region in which it surrounds the flame tube region 24. It follows from this that for the combustion products already flowing close to the outlet 59 and already markedly colder, and also taking up a smaller volume (at the same pressure), a correspondingly smaller cross section is provided, with the consequence of a more uniform heat transfer to the heat exchanger arrangement 48 over the whole length region of the interspace 58.

Figure 2:
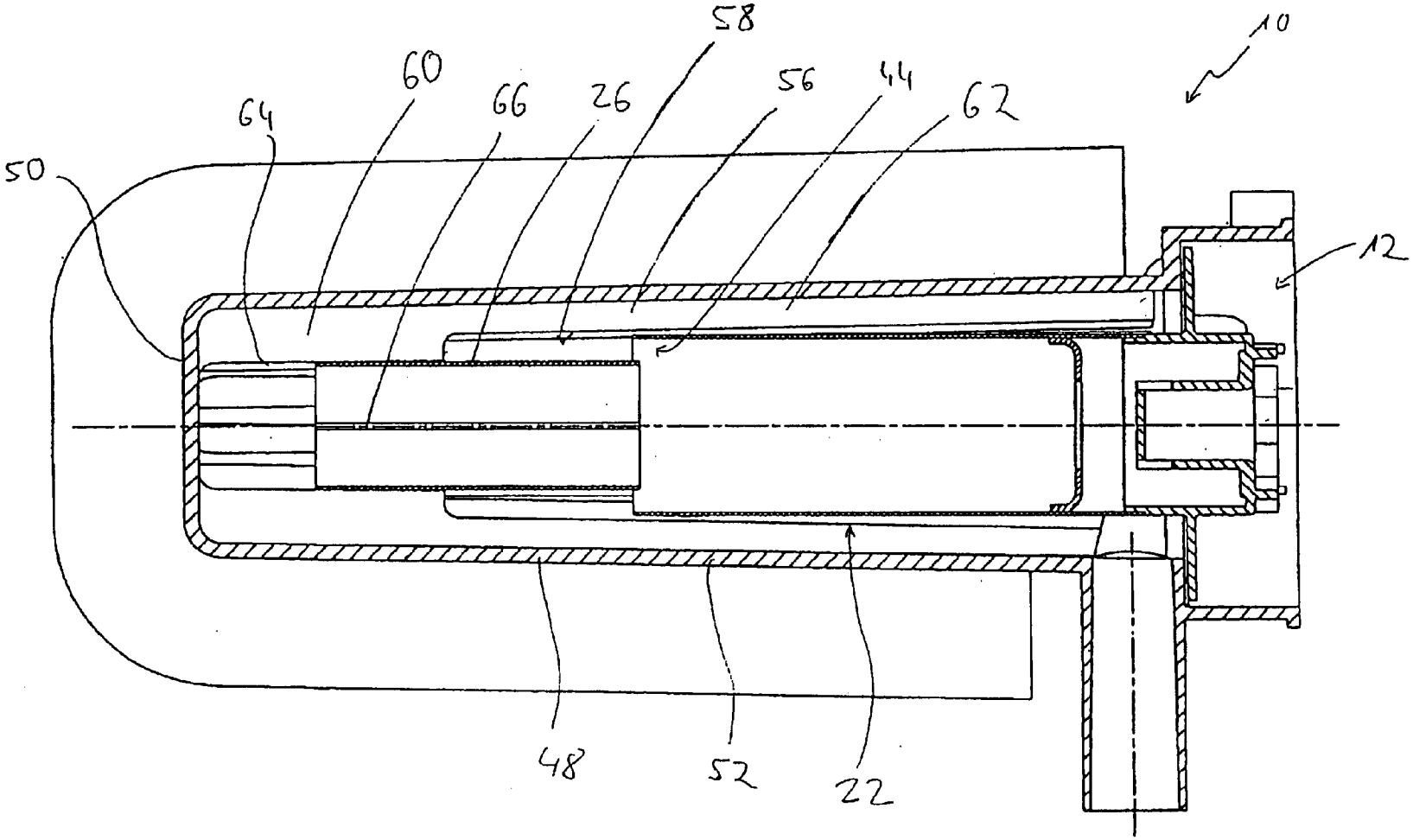
FIG. 2 shows an alternative embodiment corresponding to FIG. 1.

FIG. 2 shows an alternative embodiment of the heating device 10 according to the invention. Only the differences from the embodiment according to FIG. 1 are discussed hereinbelow, as present in the region of the mounting of the flame tube section 26 with smaller cross sectional dimension.

It can be seen in FIG. 2 that the inner ribs 56 have a greater extension length at their region 60 extending from the peripheral wall 52 of the heat exchanger housing 48 than in a region 62 located further downstream (relative to the flow direction of the combustion products in the interspace 58).

The region 60 of the inner ribs 56 also extends over a partial length region of the flame tube section 26. In this region 60, the ribs 56 are dimensioned such that their faces 64 facing radially inward form a support surface for the flame tube section 26, so that this is clamped between the inner surfaces 64, positioned peripherally around them, of the regions 60 of the inner ribs 56. In order to be able to improve this clamping action, the flame tube section 26 can have a longitudinal slot 66. On introduction of the flame tube section 26 into the rib region 60, the flame tube region 26 is peripherally compressed, so that it is stably supported on the rib regions 60 by its spreading action after introduction and release. Thus a stable mounting of the flame tube section 26 can be obtained without a connection arrangement having to be provided which impairs the aperture cross section of the intermediate outlet aperture 44. Compensation of different thermal expansions between the heat exchanger, made e.g. of aluminum, and the flame tube, made e.g. of steel, is thus made possible. In particular, the shape of the inner ribs 56 can be such, at least in the rib region 60, that the demoulding slope to be provided when a casting process is carried out has only a very small angle, so that, at least in that region in which the outlet region 36 is formed on the flame tube section 26, a firm clamping action is produced on the inner faces 64, to be tapered like a wedge relative to each other, on the flame tube section 26.

Figure 3:
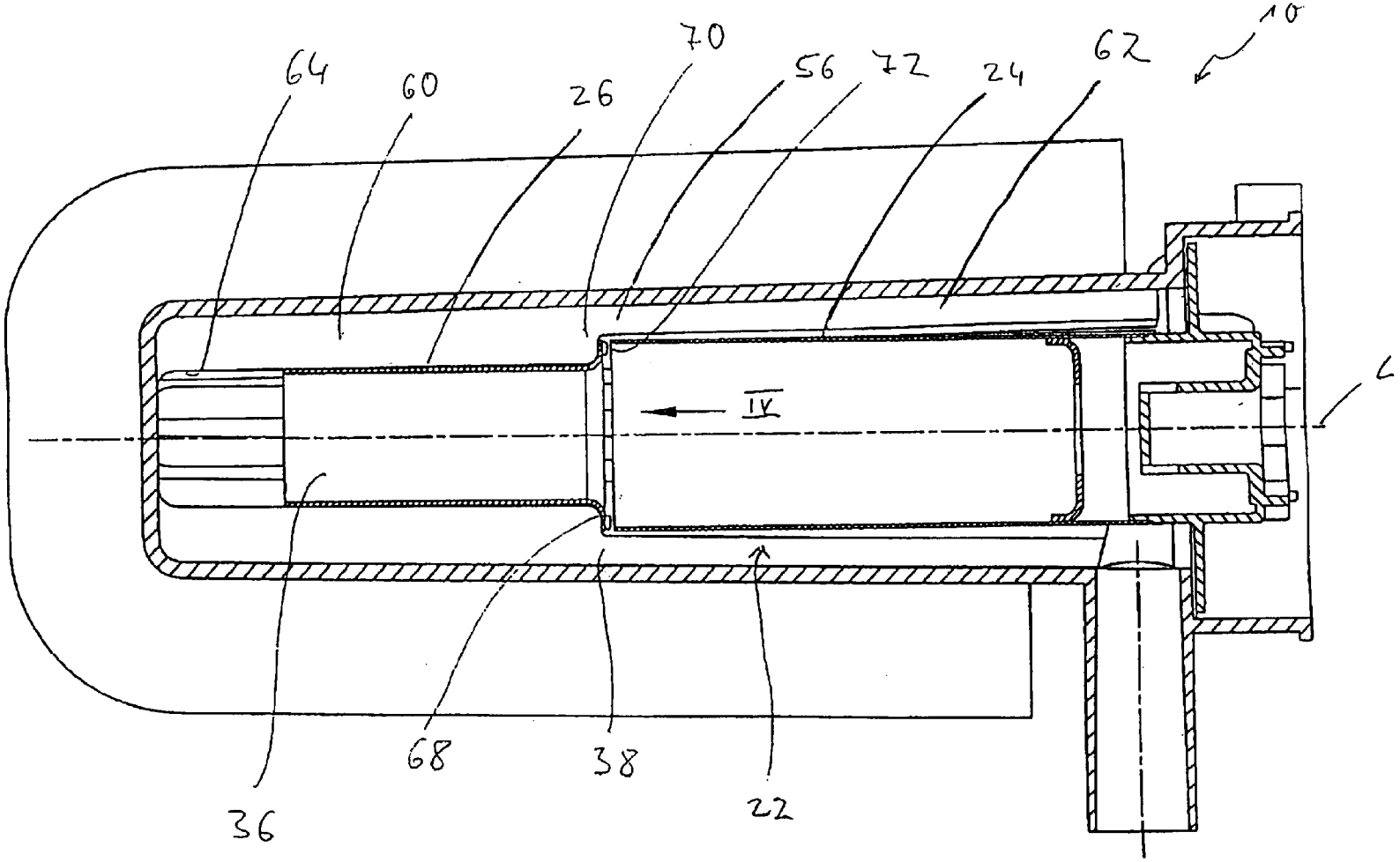
FIG. 3 shows an alternative embodiment corresponding to FIG. 1.
Figure 4:
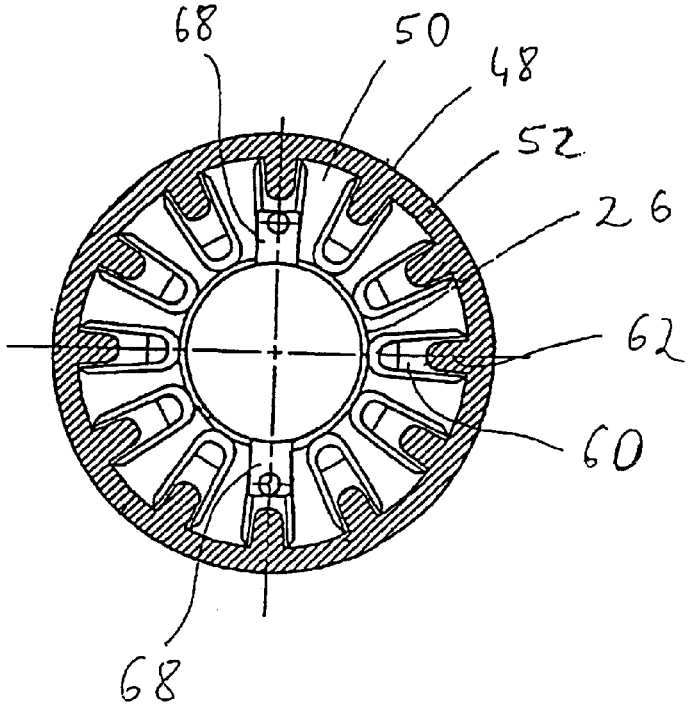
FIG. 4 shows a cross sectional view of the arrangement shown in FIG. 3, seen in the direction IV in FIG. 3.

A further modification of the heating device according to the invention is shown in FIGS. 3 and 4. Here also, only the differences are described, likewise in the region of the mounting of the flame tube section 26.

It can also be seen in FIG. 3 that the inner ribs extend further radially inward in the rib region 60 extending along the flame tube section 26 than the rib region 62 surrounding the flame tube section 24. The transition between the two rib regions 60, 62 is now however substantially also provided in the transition region 38 between the two flame tube sections 24, 26. The flame tube section 26 has fastening surfaces 68, bent radially outward, at plural peripheral positions in its end region bordering on the flame tube section 24. At the step-like transition 70 between the two rib regions 60, 62 rivet elements 72 are provided, extending in the embodiment shown approximately in the direction of the longitudinal mid-axis L, and pass through apertures in the shoulders 68 and then, when deformed, hold the shoulders 68, and thus the flame tube section 26, fast to the inner ribs 56. In addition, the rib regions 60 can be dimensioned so that they again abut firmly on the flame tube section 26 with their inner surfaces 64, so that movements of the flame tube section 26 causing rattling noises cannot occur. It is mentioned here that the fastening of the shoulders 68 to the inner ribs 56 of course does not necessarily take place with rivets, but can take place with screw elements or the like. When rivets are used, these can be embodied as blind rivets, but can also be provided as rivet elements formed on the step-like transition region 70.

It goes without saying that the heating device according to the invention or the burner arrangement 12 therefor can be modified in the most varied regions. Thus it is of course possible to provide more than two flame tube sections, and thus also more than one intermediate outlet region.

Figure 5:
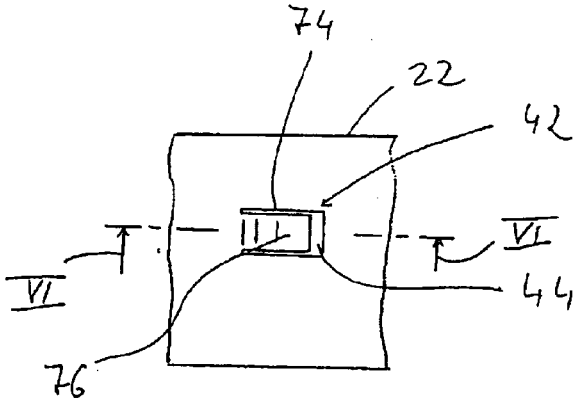
FIG. 5 shows a view of a flame tube from radially outward, in an alternative embodiment.
Figure 6:
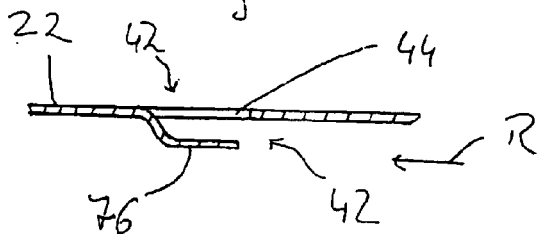
FIG. 6 shows a sectional view of the flame tube shown in FIG. 5, sectioned along the line VI—VI in FIG. 5.

In a further alternative embodiment of the invention, shown in FIGS. 5 and 6, the flame tube 22 can again be formed as a continuous material section. To form an intermediate outlet region 42, U-shaped cuts 74 can then be cut or stamped in the wall of this flame tube 22, so that the U-shaped aperture is positioned downstream with respect to the flow direction R of the combustion products in the flow tube 22. The shoulder 76 formed in this manner is bent inward, so that it projects, as shown in FIG. 6, into the spatial region surrounded by the flame tube 22 and having combustion products flowing through it in the direction R. In the region now freed from a shoulder 76, an intermediate outlet aperture 44 is formed. The combustion products flowing in the direction R along the wall region of the flame tube 22 are deflected radially outward by the guiding effect of the shoulders 76 bent into the internal space of the flame tube 22 and thus enter the interspace 58 described with reference to the foregoing embodiments. Besides being the simplest structure to be realized, this embodiment according to FIGS. 5 and 6 has the advantage that by the formation of such shoulders 76 at optional positioning of the flame tube, a complete formation of intermediate apertures 44 can be formed, whose position and width can be matched to the special requirements which specify the emergence of combustion products into intermediate regions.

Even an asymmetrical distribution of the intermediate outlet apertures 44 at the periphery of the flame tube 22 is possible with the different embodiments shown, for compensation of asymmetries in the flow of combustion products.

The alternative embodiments shown in FIGS. 5 and 6 can of course be combined with the alternatives described with reference to FIGS. 1–4.

We claim:

1. A burner arrangement for a heating device, comprising a combustion chamber (18) and a flame tube (22) conducting the combustion products away from the combustion chamber (18), having an inlet region (28) near the combustion chamber (18) at which combustion products enter the flame tube (22) and an outlet region (36) at which combustion products leave the flame tube (22), further comprising at least one intermediate outlet region (42) between the inlet region (28) and the outlet region (36), into which intermediate outlet region (42) a portion of the combustion products emerge from the flame tube (22).

2. The burner arrangement according to claim 1, wherein the flame tube (22) has at least one intermediate outlet aperture (44) in at least one intermediate outlet region (42).

3. The burner arrangement according to claim 1, wherein the flame tube (22) has at least two flame tube sections (24, 26); and wherein the at least one intermediate outlet aperture (44) is provided in a transition region (38) between an upstream flame tube section (24)—relative to the flow direction (R) of the combustion products in the flame tube (22)—and a downstream flame tube section (26).

4. The burner arrangement according to claim 3, wherein an aperture (40) in the transition region (38) between the flame tube sections (24, 26) forms a portion of an intermediate outlet aperture (44).

5. The burner arrangement according to claim 3, wherein the upstream flame tube section (24) has a greater cross sectional dimension than the downstream flame tube section (26).

6. The burner arrangement according to claim 5, wherein the downstream flame tube section (26) engages in the upstream flame tube section (24), and at least a portion of an intermediate outlet aperture (44) is provided in the overlap region of the upstream flame tube section (24) with the downstream flame tube section (26).

7. The burner arrangement according to claim 3, wherein the downstream flame tube section (26) is supported by at least one support region (46) on the upstream flame tube section (24).

8. The burner arrangement according to claim 2, wherein the upstream flame tube section (24) and the downstream flame tube section (26) are of substantially cylindrical form.

9. The burner arrangement according to claim 2, wherein the at least one intermediate outlet aperture (44) is formed in an outer wall of the flame tube (22).

10. A heating device, comprising a burner arrangement (12) according to claim 1, and a heat exchanger arrangement (14) with a heat exchanger housing (48) into which a flame tube (22) projects.

11. The heating device according to claim 10, wherein a support structure (60) for supporting at least one flame tube section (26) is provided on a side of the heat exchanger housing (48) facing the flame tube (22).

12. The heating device according to claim 11, wherein plural ribs (56) extending in the longitudinal direction of the flame tube are provided on the heat exchanger housing (48); and wherein the support structure (60) comprises at least a portion of the plural ribs (56).

13. The heating device according to claim 12, wherein the at least one flame tube section (26) is supported by clamping action between the plural ribs (56) distributed over its periphery.

14. The heating device according to claim 12, wherein the at least one flame tube section (26) is retained on at least one of the plural ribs (56) by riveting, screwing, or a like retainer.

* * * * *